US009004565B2

(12) United States Patent
Tran

(10) Patent No.: US 9,004,565 B2
(45) Date of Patent: Apr. 14, 2015

(54) ONE-PIECE CONSTRUCTION CHOPSTICKS

(71) Applicant: Tam P. Tran, San Diego, CA (US)

(72) Inventor: Tam P. Tran, San Diego, CA (US)

( * ) Notice: Subject to any disclaimer, the term of this patent is extended or adjusted under 35 U.S.C. 154(b) by 0 days.

(21) Appl. No.: 14/211,177

(22) Filed: Mar. 14, 2014

(65) Prior Publication Data

US 2014/0319865 A1 Oct. 30, 2014

Related U.S. Application Data

(60) Provisional application No. 61/854,443, filed on Apr. 24, 2013.

(51) Int. Cl.
*B66F 19/00* (2006.01)
*A47G 21/06* (2006.01)

(52) U.S. Cl.
CPC ..... *A47G 21/103* (2013.01)

(58) Field of Classification Search
CPC ..... A47G 21/103; A47G 21/10; A47G 21/02; A47G 21/06; B25J 7/00; B25J 15/0616; B25B 9/02; A61B 17/30; B65G 7/12; A47J 43/283; A47J 45/10; F24B 15/10; H01L 21/68707
See application file for complete search history.

(56) References Cited

U.S. PATENT DOCUMENTS

| | | | | |
|---|---|---|---|---|
| 3,884,456 | A | 5/1975 | Lew | |
| 3,937,510 | A | 2/1976 | Lew | |
| 4,973,095 | A | 11/1990 | Kunihisa | |
| 2002/0096899 | A1 * | 7/2002 | Kang | 294/99.2 |
| 2004/0164573 | A1 * | 8/2004 | Hao | 294/99.2 |
| 2004/0212203 | A1 * | 10/2004 | Calagui | 294/16 |
| 2005/0082855 | A1 * | 4/2005 | Baxter | 294/99.2 |
| 2009/0066097 | A1 * | 3/2009 | Lin et al. | 294/1.1 |

* cited by examiner

*Primary Examiner* — Stephen Vu
(74) *Attorney, Agent, or Firm* — Crossley Patent Law

(57) ABSTRACT

A one-piece construction chopsticks including a body having a first portion and a second portion conjoined by a U-shaped back end, the first and second portions having a respective S-shaped center portion and reverse-S shaped central portion disposed in a figure 8 position relative each other, that permits the separation of the front ends to pick up a food particle upon only the application of pressure on the center and central portions. A notch in each of the center and central portions helps to align the first and second portions and limits the size of the opening between the grasping ends.

6 Claims, 3 Drawing Sheets

ONE-PIECE CONSTRUCTION CHOPSTICKS

CROSS-REFERENCE TO RELATED APPLICATIONS

Figure 1:
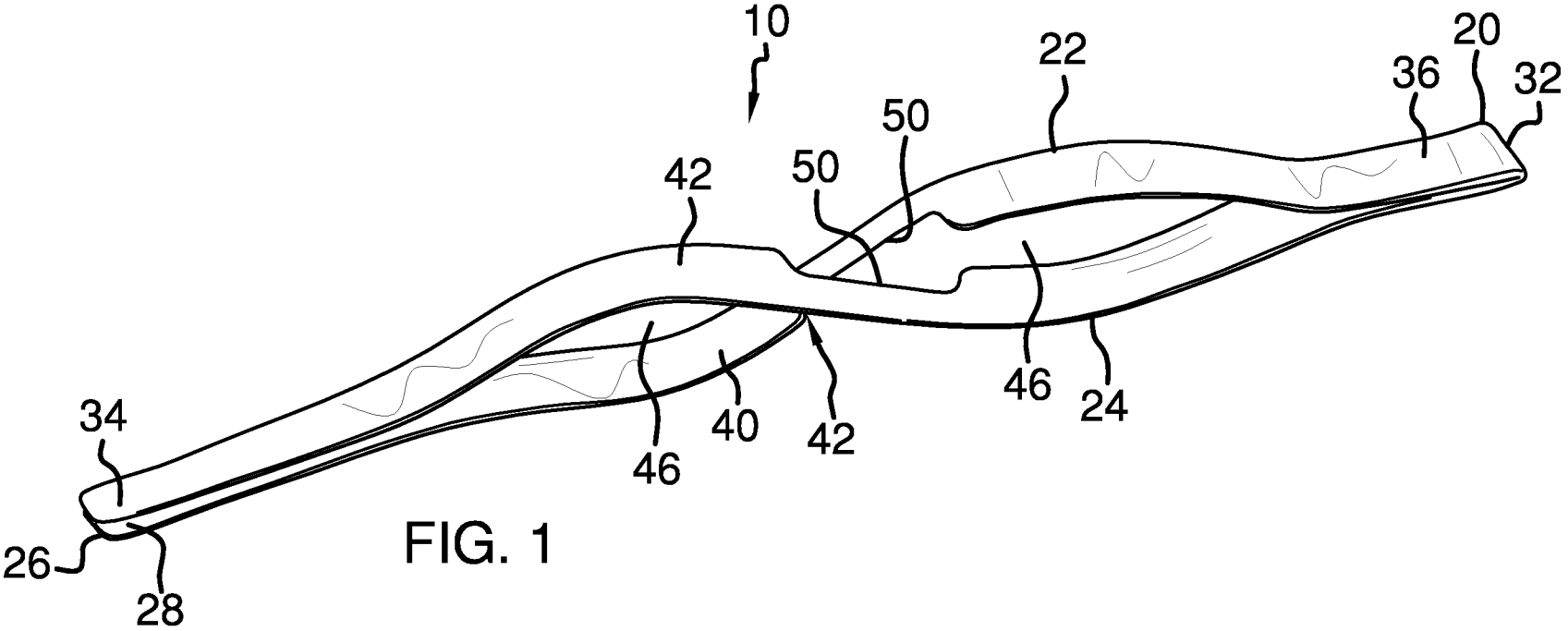

U.S. Provisional Patent Application No. 61,854,443 Filed Apr. 24, 2013

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of chopsticks are known in the prior art. Conventional chopsticks typically comprise two separate sticks that require skill to use. The present one-piece construction chopsticks include two portions disposed in a figure 8 configuration that requires only pressure in a center area thereof to secure a food particle in the grasping ends without the time and effort involved in developing the skills necessary to use conventional chopsticks. A centrally disposed notch in each portion keeps the two portions in alignment and limits the size of an opening between the grasping ends.

FIELD OF THE INVENTION

The present invention relates to implements devised for the consumption of food, and more particularly, to one-piece construction chopsticks.

SUMMARY OF THE INVENTION

The general purpose of the present one-piece construction chopsticks, described subsequently in greater detail, is to provide one-piece construction chopsticks which has many novel features that result in one-piece construction chopsticks which is not anticipated, rendered obvious, suggested, or even implied by prior art, either alone or in combination thereof.

To accomplish this, the present one-piece construction chopsticks are devised to overcome the difficulties presented by chopsticks in the form of two separate sticks to grab and lift a food particle for consumption. In order to use the two separate sticks, one must learn how to cross the sticks and manipulate the angle between the two sticks in order to apply pressure to the food particle. Using two separate sticks requires time to learn as well as dexterity and eye-hand coordination and often involves the dropping of food particles, which can lead to frustration, wasted food, stained clothing, and can require additional cleaning of the area in which the food particles are dropped and of the clothing. The present one-piece construction chopsticks overcomes the problems of two pieced chopsticks by requiring only the application of pressure on a center area the chopsticks, rather than skillful manipulation, to open the front ends to pick up the food particle and the release of pressure on the center area of the chopsticks to close the front ends to retain the food particle between the front ends.

The present device includes a continuous body formed of bendable material, such as reusable plastic or metal, which includes conjoined first and second portions, the second portion being a mirror image of the first portion. A front end of each of the first and second portions has a flat interior side, the interior sides being parallel to each other. The front ends are transformable from an adjoining position to a separated position with an opening therebetween and from a separated position to an adjoining position. A U-shaped back end between the first and second portions is longitudinally disposed relative the front ends. A forward portion and a rearward portion are disposed proximal the respective front end and the back end of each of the first and second portions. Each of the rearward portions has a gradual outward taper from the back end toward the front end.

An S-shaped center portion is disposed between the forward portion and the rearward portion of the first portion. A reverse S-shaped central portion is disposed between the forward portion and the rearward portion of the second portion. The center portion and the central portion together have a figure 8 configuration. A cross-over point is disposed at the intersection of the center portion and the central portion. A gap is disposed between the center portion and the central portion between the cross-over point and each of the forward portion and the rearward portion. A C-shaped notch is disposed in each of the center portion and the central portion proximal the cross-over point in a position between the cross-over point and the rearward portion. The notches assist in keeping the first and second portions in alignment and also to limit the size of the opening between the front ends.

Due to the figure 8 configuration of the center and central portions, upon the placement and alternate release of pressure on both the center portion and the central portion proximal the back end, the interior sides of the front ends transform from the adjoining position to the separated position to receive or release a food particle and alternately from the separated position to the adjoining position to secure the food particle therebetween, respectively.

Thus has been broadly outlined the more important features of the present one-piece construction chopsticks so that the detailed description thereof that follows may be better understood and in order that the present contribution to the art may be better appreciated.

BRIEF DESCRIPTION OF THE DRAWINGS FIGURES

Figure 2:
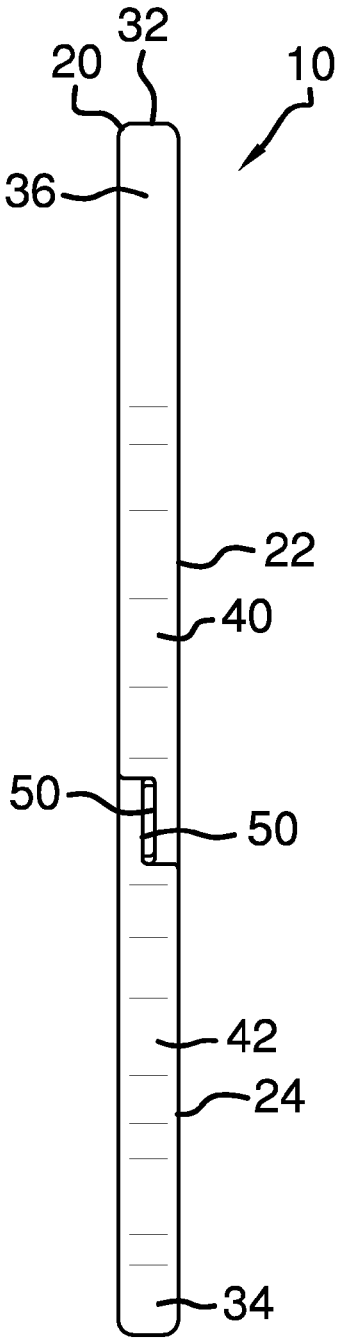
Figure 3:
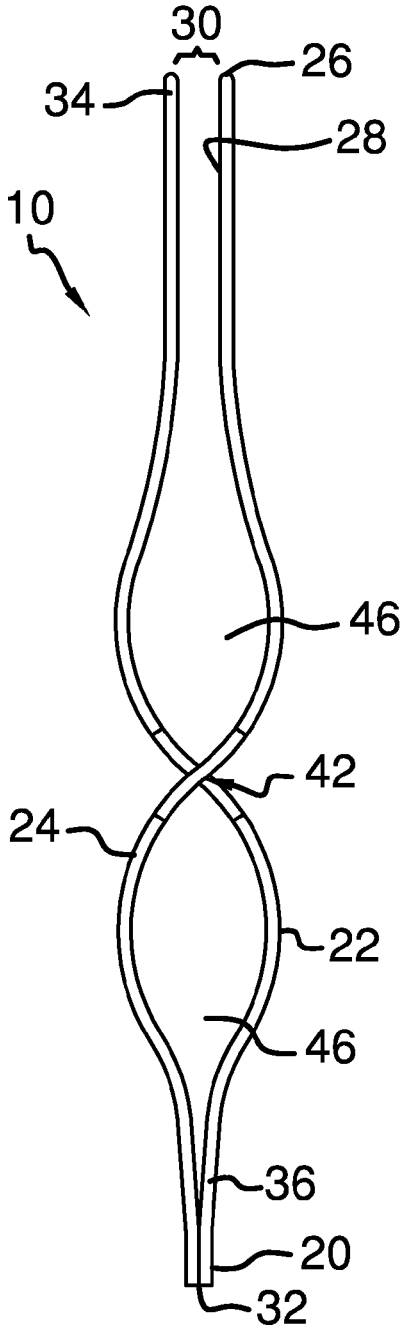
Figure 4:
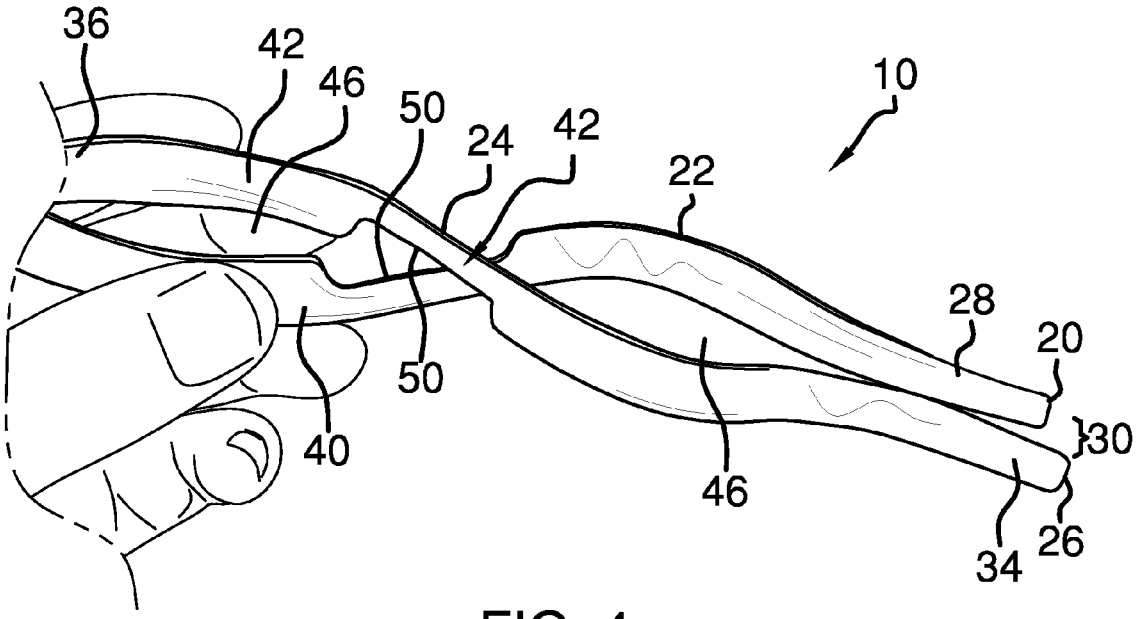

FIG. 1 is an isometric view.
FIG. 2 is a top plan view.
FIG. 3 is a side elevation view.
FIG. 4 is an in-use view.

DETAILED DESCRIPTION OF THE DRAWINGS

With reference now to the drawings, and in particular FIGS. 1 through 4 thereof, an example of the instant one-piece construction chopsticks employing the principles and concepts of the present one-piece construction chopsticks and generally designated by the reference number 10 will be described.

Referring to FIGS. 1 through 4 the present one-piece construction chopsticks 10 is illustrated. The one-piece construction chopsticks 10 include a continuous body 20 formed of bendable material. The body 20 includes a first portion 22 and a second portion 24 conjoined to the first portion 22. The second portion 24 is a mirror image of the first portion 22. Each of the first portion 22 and the second portion 24 has a front end 26. Each front end 26 has a flat interior side 28. The interior sides 28 of the front ends 26 are in a position parallel to each other. The front ends 26 are transformable from an adjoining position to a separated position and from a separated position to an adjoining position. An opening 30 is disposed between the front ends 26 upon transforming the front ends 26 to a separated position. A U-shaped back end 32 is disposed between the first portion 22 and the second portion 24. The back end 32 is opposite the front ends 26 and is disposed in a longitudinal position relative the front ends 26.

A forward portion 34 is disposed proximal each front end 26. A rearward portion 36 of each of the first and second portions 22, 24 is disposed proximal the back end 32. Each of the rearward portions 36 has a gradual outward taper from the back end 32 toward the front end 26. An S-shaped center portion 40 is disposed between the forward portion 34 and the rearward portion 36 of the first portion 22. A reverse S-shaped central portion 42 is disposed between the forward portion 34 and the rearward portion 36 of the second portion 24. The center portion 40 and the central portion 42 together have a figure 8 configuration. A cross-over point 44 is disposed at the intersection of the center portion 40 and the central portion 42. A gap 46 is disposed between the center portion 40 and the central portion 42 between the cross-over point 44 and each of the forward portion 34 and the rearward portion 36.

A C-shaped notch 50 is disposed in each of the center portion 40 and the central portion 42 proximal the cross-over point 44 in a position between the cross-over point 44 and the rearward portion 36. The notches 50 assist in keeping the first and second portions 22, 24 in alignment and also to limit the size of the opening 30 between the front ends 26.

In use, due to the figure 8 configuration of the center and central portions 40, 42, upon the placement and alternate release of pressure on both the center portion 40 and the central portion 42 proximal the back end 32, the interior sides 28 of the front ends 26 transform from the adjoining position to the separated position and alternately from the separated position to the adjoining position, respectively. Upon placement of the interior sides 28 of the front ends 26 in the separated position, the body 20 is configured to receive a food particle between the interior sides 28 and alternately release a food particle secured between the interior sides 28. Upon placement of the interior sides 28 of the front ends 26 in the adjoining position, the body 20 is configured to retain a food particle between the interior sides 28.

The bendable material is one of a plastic and a metal. The plastic is recycled plastic. Other materials suitable for performing the functions of the present device 10 may also be employed.

What is claimed is:

1. A one-piece construction chopsticks comprising:

a continuous body comprising:

a first portion;

a second portion conjoined to the first portion, the second portion being a mirror image of the first portion;

a front end of each of the first portion and the second portion, each front end having a flat interior side, the interior sides of the front ends being in a position parallel to each other, the front ends being transformable from an adjoining position to a separated position and from a separated position to an adjoining position;

an opening between the front ends upon transforming the front ends to a separated position;

a U-shaped back end disposed between the first portion and the second portion, the back end being opposite the front ends, the back end further disposed in a longitudinal position relative the front ends a forward portion disposed proximal each front end;

a rearward portion of each of the first and second portions proximal the back end, each of the rearward portions having a gradual outward taper from the back end toward the front end;

an S-shaped center portion disposed between the forward portion and the rearward portion of the first portion;

a reverse S-shaped central portion disposed between the forward portion and the rearward portion of the second portion, wherein the center portion and the central portion together have a figure 8 configuration;

a cross-over point disposed at the intersection of the center portion and the central portion;

a gap disposed between the center portion and the central portion between the cross-over point and each of the forward portion and the rearward portion; and a notch disposed in each of the center portion and the central portion proximal the cross-over point in a position between the cross-over point and the rearward portion;

wherein upon the placement and alternate release of pressure on both the center portion and the central portion proximal the back end, the interior sides of the front ends transform from the adjoining position to the separated position and alternately from the separated position to the adjoining position, respectively.

2. The chopsticks of claim 1 wherein upon placement of the interior sides of the front ends in the separated position, the body is configured to receive a food particle between the interior sides and alternately release a food particle secured between the interior sides; and wherein upon placement of the interior sides of the front ends in the adjoining position, the body is configured to retain a food particle between the interior sides.

3. The chopsticks of claim 2 wherein each notch is C-shaped.

4. A one-piece construction chopsticks comprising:

a continuous body formed of bendable material, the body comprising:

a first portion;

a second portion conjoined to the first portion, the second portion being a mirror image of the first portion;

a front end of each of the first portion and the second portion, each front end having a flat interior side, the interior sides of the front ends being in a position parallel to each other, the front ends being transformable from an adjoining position to a separated position and from a separated position to an adjoining position;

an opening between the front ends upon transforming the front ends to a separated position;

a U-shaped back end disposed between the first portion and the second portion, the back end being opposite the front ends, the back end further disposed in a longitudinal position relative the front ends a forward portion disposed proximal each front end;

a rearward portion of each of the first and second portions proximal the back end, each of the rearward portions having a gradual outward taper from the back end toward the front end;

an S-shaped center portion disposed between the forward portion and the rearward portion of the first portion;

a reverse S-shaped central portion disposed between the forward portion and the rearward portion of the second portion, wherein the center portion and the central portion together have a figure 8 configuration;

a cross-over point disposed at the intersection of the center portion and the central portion;

a gap disposed between the center portion and the central portion between the cross-over point and each of the forward portion and the rearward portion; and a C-shaped notch disposed in each of the center portion and the central portion proximal the cross-over point in a position between the cross-over point and the rearward portion;

wherein upon the placement and alternate release of pressure on both the center portion and the central portion proximal the back end, the interior sides of the front ends transform from the adjoining position to the separated position and alternately from the separated position to the adjoining position, respectively;

wherein upon placement of the interior sides of the front ends in the separated position, the body is configured to receive a food particle between the interior sides and alternately release a food particle secured between the interior sides; and wherein upon placement of the interior sides of the front ends in the adjoining position, the body is configured to retain a food particle between the interior sides.

5. The chopsticks of claim 4 wherein the bendable material is one of a plastic and a metal.

6. The chopsticks of claim 5 wherein the plastic is recycled plastic.

* * * * *